US007744986B2

(12) United States Patent
Rice et al.

(10) Patent No.: US 7,744,986 B2
(45) Date of Patent: Jun. 29, 2010

(54) MULTILAYERED EROSION RESISTANT COATING FOR GAS TURBINES

(75) Inventors: Derek A. Rice, Morristown, NJ (US); Adrienne Lamm, Morristown, NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 12/275,566

(22) Filed: Nov. 21, 2008

(65) Prior Publication Data

US 2009/0075043 A1 Mar. 19, 2009

Related U.S. Application Data

(62) Division of application No. 11/205,732, filed on Aug. 16, 2005, now abandoned.

(51) Int. Cl.
*B32B 7/02* (2006.01)

(52) U.S. Cl. ..... 428/212; 428/615; 428/635; 428/655; 428/660; 428/686; 428/687; 428/689; 428/697; 428/704; 428/701; 428/702

(58) Field of Classification Search ..... None
See application file for complete search history.

(56) References Cited

U.S. PATENT DOCUMENTS

| | | | |
|---|---|---|---|
| 3,951,612 | A | 4/1976 | Gates et al. |
| 4,318,672 | A | 3/1982 | Hansen |
| 4,401,719 | A | 8/1983 | Kobayashi et al. |
| 4,605,452 | A | 8/1986 | Gemma et al. |
| 4,741,975 | A | 5/1988 | Naik et al. |
| 4,761,346 | A | 8/1988 | Naik |
| 4,839,245 | A | 6/1989 | Sue et al. |
| 4,895,765 | A | 1/1990 | Sue et al. |

(Continued)

FOREIGN PATENT DOCUMENTS

| | | | |
|---|---|---|---|
| EP | 0188057 | A1 | 7/1986 |

(Continued)

OTHER PUBLICATIONS

PCT Search Report dated Jun. 4, 2008, PCT/US2006/021299.

(Continued)

*Primary Examiner*—Ling Xu
(74) *Attorney, Agent, or Firm*—Ingrassia Fisher & Lorenz, P.C.

(57) ABSTRACT

A coating system is used on an engine component having an outer surface configured to be exposed to a first plurality of particles impinging against the outer surface at an angle within a first angle range and a second plurality of particles impinging at an angle in a second angle range. The system includes a bond layer overlying the engine component outer surface, a first erosion-resistant layer comprising a first material that is more resistant to erosion by particles impinging the component outer surface at an angle within the first angle range than by particles impinging within the second angle range, an interlayer overlying the first erosion-resistant layer, and a second erosion-resistant layer comprising a second material that is more resistant to erosion by particles impinging the component outer surface at an angle within the second angle range than by particles impinging within the first angle range.

9 Claims, 1 Drawing Sheet

U.S. PATENT DOCUMENTS

| | | | |
|---|---|---|---|
| 4,904,542 | A | 2/1990 | Mroczkowski |
| 4,927,713 | A | 5/1990 | Garg et al. |
| 5,006,371 | A | 4/1991 | Garg et al. |
| RE34,173 | E | 2/1993 | Kerber |
| 5,350,599 | A | 9/1994 | Rigney et al. |
| 5,702,829 | A | 12/1997 | Paidassi et al. |
| 5,843,586 | A | 12/1998 | Schaeffer et al. |
| 6,387,526 | B1 | 5/2002 | Beele |
| 6,387,539 | B1 | 5/2002 | Subramanian |
| 2002/0132131 | A1 | 9/2002 | Bossmann et al. |
| 2004/0170859 | A1 | 9/2004 | Darolia et al. |

FOREIGN PATENT DOCUMENTS

| | | | |
|---|---|---|---|
| EP | 0264654 | A1 | 4/1988 |
| EP | 0323388 | A2 | 7/1989 |
| EP | 0674020 | A1 | 9/1995 |
| WO | 8000988 | A1 | 5/1980 |
| WO | 9936193 | A1 | 7/1999 |

OTHER PUBLICATIONS

Y. Gachon, P. Ienny, A. Forner, G. Farges, M.G. Sainte Catherine, and A.B. Vannes, Erosion by Solid Particles of W/W-N Multilayer Coatings Obtained by PVD Process, Surface and Coatings Technology 113 (1999) pp. 140-148.

E. Quesnel, Y. Pauleau, P. Monge-Cadet and M. Brun, Tungsten and Tungsten—Carbon PVD Multilayered Structures as Erosion-Resistant Coatings, Surface and Coatings Technology 62 (1993) pp. 474-479.

MULTILAYERED EROSION RESISTANT COATING FOR GAS TURBINES

CROSS-REFERENCE TO RELATED APPLICATION

This application is a divisional of U.S. application Ser. No. 11/205,732, filed on Aug. 16, 2005.

TECHNICAL FIELD

The present invention relates to aircraft components and, more particularly, to a coating system for use on aircraft components.

BACKGROUND

Turbine engines may be used as the primary power source for aircraft or as auxiliary power sources for driving air compressors, hydraulic pumps, and the like. A turbine engine includes a fan, a compressor, a combustor, a turbine, and an exhaust. To provide power, the fan draws air into the engine, and the air is compressed by the compressor. The compressed air is then mixed with fuel and ignited by the combustor. The resulting hot combustion gases are directed against blades that are mounted to a wheel of the turbine. As a result, the gas flows partially sideways to impinge on the blades causing the wheel to rotate and to generate energy. The gas then leaves the engine via the exhaust.

In many cases, the compressor is coated with thermally-resistant materials that protect against heat that are present during engine operation. The coating may be a single or multiple layers of metal and/or ceramic material. However, when the air is drawn into the engine and compressed, other particles, such as ash, sand, or dirt, may be unintentionally drawn into the engine. Although the coating is generally sufficiently robust to withstand impacts from these relatively small particles, certain sections of the coating, such as those sections subjected to repeated contact with particles, may begin to wear over time. Consequently, these sections may experience unacceptably high rates of degradation which may result, in many cases, in the need for component repair and/or replacement. Additionally, significant operating expense and time out of service may be incurred.

Hence, there is a need for a coating that improves wear resistance of an aircraft component, such as a compressor. Moreover, it is desirable for the coating to be relatively inexpensive and simple to apply.

BRIEF SUMMARY

The present invention provides an erosion-resistant coating system for use on an engine component having an outer surface that is configured to be exposed to a first plurality of particles impinging against the outer surface at an angle within a first angle range and a second plurality of particles impinging against the outer surface at an angle in a second angle range that is different than the first angle range. The system comprises a bond layer overlying the engine component outer surface, the bond layer comprising an amorphous material, a first erosion-resistant layer overlying the bond layer, the first erosion-resistant layer comprising a first material that is more resistant to erosion by particles impinging the component outer surface at an angle within the first angle range than by particles impinging within the second angle range, an interlayer overlying the first erosion-resistant layer, the interlayer comprising the amorphous material, and a second erosion-resistant layer overlying the interlayer, the second erosion-resistant layer comprising a second material that is more resistant to erosion by particles impinging the component outer surface at an angle within the second angle range than by particles impinging within the first angle range.

In another embodiment, the system includes also includes a bond layer, first erosion-resistant layer, an interlayer, and a second erosion-resistant layer. In this embodiment, however, the bond layer overlies the engine component outer surface and comprises a material comprising a first crystallographic structure. The first erosion-resistant layer overlies the bond layer and comprising a first material that is more resistant to erosion by particles impinging the component outer surface at an angle within the first angle range than by particles impinging within the second angle range and at least a portion of the first material having the first crystallographic structure. The interlayer overlies the first erosion-resistant layer and comprises a material comprising a second crystallographic structure. The second erosion-resistant layer overlies the interlayer and comprises a second material that is more resistant to erosion by particles impinging the component outer surface at an angle within the second angle range than by particles impinging within the first angle range, at least a portion of the second material having the second crystallographic structure.

In still another embodiment, a method is provided of coating an engine component having an outer surface, where the coating configured to be exposed to a first plurality of particles impinging against the outer surface at an angle within a first angle range and a second plurality of particles impinging against the outer surface at an angle in a second angle range that is different than the first angle range. The method includes forming a bond layer overlying the engine component outer surface, the bond layer comprising an amorphous material, depositing a first material over the bond layer to form a first erosion-resistant layer comprising a first material that is more resistant to erosion by particles impinging the component outer surface at an angle within the first angle range than by particles impinging within the second angle range, forming an interlayer overlying the first erosion-resistant layer, the interlayer comprising the amorphous material, and depositing a second material over the interlayer to form a second erosion-resistant layer that is more resistant to erosion by particles impinging the component outer surface at an angle within the second angle range than by particles impinging within the first angle range.

In still yet another embodiment, the method includes the steps of forming a bond layer overlying the engine component outer surface, the bond layer comprising a material comprising a first crystallographic structure, depositing a first material overlying the bond layer to form a first erosion-resistant layer that is more resistant to erosion by particles impinging the component outer surface at an angle within the first angle range than by particles impinging within the second angle range, at least a portion of the first material having the first crystallographic structure, forming an interlayer overlying the first erosion-resistant layer, the interlayer comprising a material comprising a second crystallographic structure, and depositing a second material overlying the interlayer to form a second erosion-resistant layer that is more resistant to erosion by particles impinging the component outer surface at an angle within the second angle range than by particles impinging within the first angle range, at least a portion of the second material having the second crystallographic structure.

Other independent features and advantages of the preferred coating system and methods will become apparent from the following detailed description, taken in conjunction with the accompanying drawings which illustrate, by way of example, the principles of the invention.

DETAILED DESCRIPTION OF A PREFERRED EMBODIMENT

Figure 1:
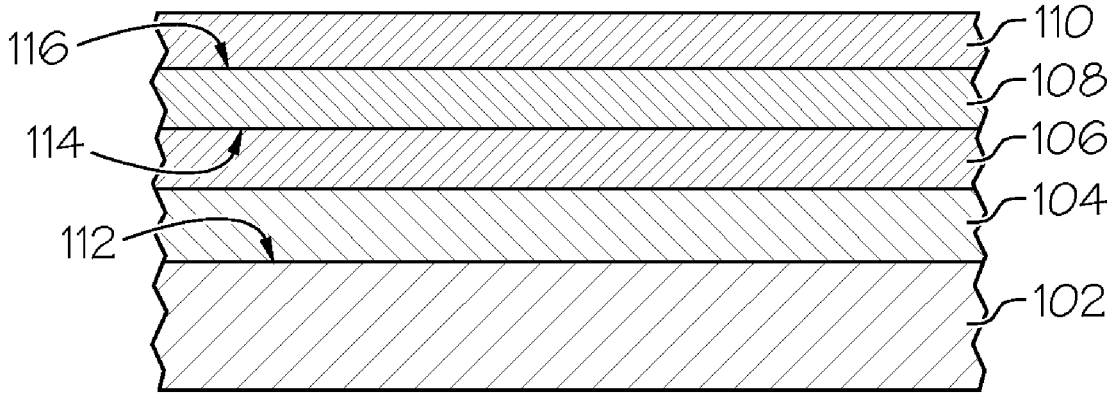
FIG. 1 is a cross section of an exemplary multilayered coating that may be formed on a conventional aircraft component.

The following detailed description of the invention is merely exemplary in nature and is not intended to limit the invention or the application and uses of the invention. Furthermore, there is no intention to be bound by any theory presented in the preceding background of the invention or the following detailed description of the invention.

FIG. 1 illustrates an exemplary multilayered coating system 100. The system 100 may be incorporated into any conventional aircraft component and is configured to resist erosion that may be caused by the impingement of small particles, such as sand, against the aircraft component. The system 100 includes a substrate 102, a bond layer 104, a first erosion-resistant layer 106, an interlayer 108, and a second erosion-resistant layer 110.

The substrate 102 may be any aircraft component, such as, for example, a compressor, or compressor airfoil. Accordingly, the substrate 102 is made of any material from which an aircraft component may be constructed, such as, for example, any aluminum-base alloy, nickel-base alloy, steel, titanium-base alloy, or cobalt-base alloy. The substrate 102 has a substrate surface 112 which may have any texture, such as, for example, a roughened surface or a smooth surface.

The bond layer 104 provides a transition between the substrate 102 and the first erosion-resistant layer 106 and provides a surface to which the first erosion-resistant layer 106 can bond. The bond layer 104, deposited over and adhered to the substrate surface 112, has either an amorphous structure or a predetermined crystallographic structure. Each type of structure may be used in a different circumstance. For instance, when the first erosion-resistant layer 106 is to be constructed having a crystallographic orientation that is not influenced by adjacent layers, an amorphous structure may be preferable.

A predetermined crystallographic structure is employed for the bond layer 104 when the first erosion-resistant layer 106 and the bond layer 104 are to assume the same crystallographic orientation. It will be appreciated that the material used to construct this type of bond layer 104 may be dependent upon the particular structure that is desired. Suitable materials having accommodating crystallographic structures include, but are not limited to, alloys containing nickel, titanium, chromium, palladium, platinum, or combinations thereof. However, any other suitable material may alternatively be used.

The first and the second erosion-resistant layers 106, 110, and the interlayer 108 are each formed over the bond layer 104. As briefly mentioned above, the aircraft component may be exposed to a plurality of particles impinging against the outer surface of the component at various angles. For example, the aircraft component may be exposed to a first plurality of particles that impinge at an angle within a first angle range and a second plurality of particles impinging against the outer surface at an angle in a second angle range that is different than the first angle range. Preferably, the first and second erosion-resistant layers 106, 110 are configured to resist erosion from particles that contact the layers 106, 110 at predetermined angles.

In this regard, the first erosion-resistant layer 106 comprises a first material that is more resistant to erosion by particles impinging the component outer surface at an angle within the first angle range than by particles impinging within the second angle range, while the second erosion-resistant layer 110 comprises a second material that is more resistant to erosion by particles impinging the component outer surface at an angle within the second angle range than by particles impinging within the first angle range. More specifically, each of the erosion-resistant layers 106, 110 is constructed to have a crystallographic structure that is suitable for withstanding contact with a particle at a particular predetermined angle. In one example, the first erosion-resistant layer 106 is constructed to withstand particle impact at an angle that is less than about 45 degrees with respect to the substrate surface 112 and thus, has a first crystallographic orientation, while the second erosion-resistant layer 110 is formed to withstand particle impact at angle that is greater than 45 degrees with respect to the substrate surface 112 and has a second crystallographic orientation that is different than the first crystallographic orientation.

It will be appreciated that the material used to construct the first and the second erosion-resistant layers 106, 110 may be dependent upon the particular crystallographic structure that is desired. Additionally, the first and second erosion-resistant layers 106, 110 may or may not be formed from the same materials. Some suitable materials may comprise titanium, tungsten, zirconium, lanthium, hafnium, tantalum, rhenium, chromium, and aluminum metals. Alternatively, the materials may comprise transition metals, zirconium, tungsten, titanium, and/or chromium doped with at least one of boron, carbon, nitrogen, or oxygen. It will be appreciated that any other suitable material may be used.

The interlayer 108 is interposed between the first erosion-resistant layer 106 and the second erosion-resistant layer 110, and provides a transition therebetween. In this regard, the interlayer 108 is similar to the bond layer 104 and may be an amorphous structure or a structure having a predetermined crystallographic structure. Alternatively, the interlayer 108 may be a graded structure. In an embodiment in which an amorphous structure is used, the interlayer 108 provides a surface having no particular crystallographic orientation to thereby allow the second erosion-resistant layer 110 to more easily form its predetermined crystallographic structure thereover. In an alternative embodiment in which the predetermined crystallographic structure is formed, the interlayer 108 is used to facilitate the formation of the crystallographic orientation of the second erosion-resistant layer 110. In either case, the interlayer 108 may comprise the same material as the bond layer 104.

In an embodiment in which the interlayer 108 is a graded structure, the interlayer 108 had a first surface 114 and a second surface 116. The first surface 114 directly contacts the first erosion-resistant layer 106 and has a first crystallographic structure that corresponds thereto. The second surface 116 directly contacts the second erosion-resistant layer 110 and has a second, different crystallographic structure that corresponds to that of the second erosion-resistant layer 110. Preferably, the portion of the interlayer 108 disposed between the first and second contact surfaces 114, 116 is formed such that a gradual change exists between the crystallographic orientations of the first and second surfaces 114, 116.

Although only two erosion-resistant layers 106, 110 and one interlayer 108 are depicted in FIG. 1, it will be appreciated that more layers are preferred. Most preferably, the coating system 100 includes a plurality of erosion-resistant layers that are each configured to protect the aircraft component against particles that may strike from a particular angle, for example, angles that are less than or equal to 90 degrees with respect to the substrate surface 112 or to the surface of the particular erosion-resistant layer. As a result, the coating system 100 can withstand impact from particles striking from any angle.

It will be appreciated that the coating system 100 may be produced using any one of numerous conventional techniques. In one exemplary embodiment, the substrate surface 112 is prepared, for example, roughened or smoothed, to receive the bond layer 104. Next, the bond layer 104, first erosion-resistant layer 106, the interlayer 110, and the second erosion-resistant layer 108 are deposited over the substrate layer 102, respectively. As mentioned previously, each of the layers has a predetermined crystallographic structure, an amorphous structure, or a graded structure. Hence, any suitable deposition technique for constructing the desired crystallographic orientation may be employed. In one exemplary embodiment, a physical vapor deposition ("PVD") process is used. To produce layers that have varying crystallographic structures, parameters of the PVD process, for example, temperatures, coating material sources, partial pressures, composition of the gas used in the equipment and/or the layer thicknesses, may be varied.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An erosion-resistant coating system for use on an engine component having an outer surface that is configured to be exposed to a first plurality of particles impinging against the outer surface at an angle within a first angle range and a second plurality of particles impinging against the outer surface at an angle in a second angle range that is different than the first angle range, the system comprising:

a bond layer overlying the engine component outer surface, the bond layer comprising a first material having an amorphous structure;

a first erosion-resistant layer overlying the bond layer, the first erosion-resistant layer comprising a first material having a first predetermined crystallographic structure that is not the amorphous structure and that is more resistant to erosion by particles impinging the component outer surface at a first angle within the first angle range than by particles impinging the component outer surface at a second angle within the second angle range;

an interlayer overlying the first erosion-resistant layer, the interlayer comprising a second material having an amorphous structure; and a second erosion-resistant layer overlying the interlayer, the second erosion-resistant layer comprising a second material having a second predetermined crystallographic structure that is different from the first predetermined crystallographic structure, is not the amorphous structure, and that is more resistant to erosion by particles impinging the component outer surface at a third angle within the second angle range than by particles impinging the component outer surface at a fourth angle within the first angle range.

2. The coating system of claim 1, wherein the bond layer and the interlayer comprise different amorphous materials.

3. The coating system of claim 1, wherein the bond layer and the interlayer comprise the same amorphous materials.

4. The coating system of claim 1, wherein the amorphous material comprises a superalloy.

5. The coating system of claim 4, wherein the superalloy comprises at least one metal selected from the group consisting of nickel, titanium, chromium, palladium, and platinum.

6. The coating system of claim 1, wherein the first material comprises at least one element selected from the group consisting of titanium, tungsten, zirconium, lanthium, hafnium, tantalum, rhenium, chromium, and aluminum.

7. The coating system of claim 1, wherein the first erosion-resistant layer comprises a doped transition metal.

8. The coating system of claim 1, wherein the first erosion-resistant layer comprises a transition metal doped with a material selected from the group consisting of boron, carbon, nitrogen, and oxygen.

9. The coating system of claim 1, wherein the first angle range includes angles less than about 45 degrees relative to the component outer surface and the second angle range includes angles greater than about 45 degrees with respect to the component outer surface.

* * * * *